US009486053B2

(12) United States Patent
Wu

(10) Patent No.: US 9,486,053 B2
(45) Date of Patent: Nov. 8, 2016

(54) COATING DEVICE

(71) Applicant: Chun-Hung Wu, New Taipei (TW)

(72) Inventor: Chun-Hung Wu, New Taipei (TW)

( * ) Notice: Subject to any disclaimer, the term of this patent is extended or adjusted under 35 U.S.C. 154(b) by 20 days.

(21) Appl. No.: 14/604,496

(22) Filed: Jan. 23, 2015

(65) Prior Publication Data

US 2015/0208786 A1 Jul. 30, 2015

(30) Foreign Application Priority Data

Jan. 29, 2014 (TW) ..... 103103664 A

(51) Int. Cl.
*A45D 34/04* (2006.01)

(52) U.S. Cl.
CPC ..... *A45D 34/04* (2013.01); *A45D 2200/155* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,883,287 | B2 * | 2/2011 | Thorpe | A45D 34/04 401/265 |
| 7,959,369 | B2 * | 6/2011 | Gueret | A45D 34/00 401/1 |
| 8,864,401 | B2 * | 10/2014 | Duru | A45D 34/04 401/1 |
| 9,155,372 | B2 * | 10/2015 | Gieux | A45D 34/04 |
| 9,277,798 | B2 * | 3/2016 | Moreau | A45D 34/04 |

* cited by examiner

*Primary Examiner* — David Walczak
(74) *Attorney, Agent, or Firm* — Muncy, Geissler, Olds & Lowe, P.C.

(57) ABSTRACT

A coating device includes a body and a thermoelectric cooling plate. The body defines a receiving space and a storage groove and includes a contact plane and a feeding pipe. The contact plane includes a cooling region and a heating region which are cooled and heated by the thermoelectric plate, respectively. The storage groove is provided for storing a coating material. The storage groove communicates with outside of the body through the feeding pipe. When the body is moved from a first position to a second position of the target object, the coating material is heated by the heating region, cooled by the cooling region, and coated on the surface of target object.

17 Claims, 9 Drawing Sheets

1

COATING DEVICE

CROSS-REFERENCES TO RELATED APPLICATIONS

This non-provisional application claims priority under 35 U.S.C. §119(a) on Patent Application No. 103103664 filed in Taiwan, R.O.C. on 2014 Jan. 29, the entire contents of which are hereby incorporated by reference.

BACKGROUND

Technical Field

The instant disclosure relates to a coating device, in particular, to a biphasic (hot and cold) coating device.

Related Art

Nowadays, skincare and healthcare become important with the improvement in living quality in residential places. For example, personal skincare apparatuses are developed such that users can freely operate these apparatuses in their living places, in conjunction with lotions, body care products, skincare products, or other cosmetics to provide skincare effects. As a result, users can enjoy professional skincare services in their own living places as in the beauty centers.

Undoubtedly, ultrasonic beauty care apparatuses are one of the most popular beauty care instruments. The ultrasonic beauty care apparatuses can provide oscillation to the skincare products to divide the bulk skincare products into small particles, such that the small particles can be absorbed by user's skin easily and the skincare effect of the skincare products can be improved.

However, the conventional beauty care apparatuses can only provide a simple vibration effect and perform limited effect for the skin to absorb skin care products. Therefore, how to improve the efficiency of the beauty care apparatuses and/or the medical auxiliary apparatuses becomes an issue for related personnel.

Next, during applying beauty products to the skin of a client, the therapist has to be in contact with the client. The physical contact might result in the discomfort and damaging of the therapist's physique. In addition, carrying out the application of the beauty products without any auxiliary equipment is physically demanding, time consuming and less hygienic.

SUMMARY

To address these issues, the instant disclosure provides a coating device. The coating device is adapted to selectively provide users with functions of temperature difference and/or vibration while a user is applying beauty products like sunscreen, moisturizing, functional, or medical fluids/semi-fluids (such as lotions, creams, oils, etc.) In other words, the coating device is adapted to achieve different effects within single applying procedure or by separate procedures. Specifically, the coating device is adapted to heat and apply the beauty products first and then cool the applied beauty products down within one procedure. Alternatively, the coating device is adapted to cool the beauty products down first and then heat the cooled beauty products to activate the beauty products. Besides, the coating device can be simply acted as a heating means for activating the coating material or a cooling means for the refining of the skin pores.

The coating device comprises a body and a thermoelectric cooling plate. The body defines a receiving space therein. The body comprises a contact plane and a storage groove.

The contact plane is at one of two sides of the body, and the contact plane has a first portion and a second portion. The storage groove is defined at the body and nearby the first portion of the contact plane and provided for storing a coating material. The thermoelectric cooling plate is received in the receiving space and comprises a heating plane and a cooling plane. The heating plane is facing toward one of two parts of the receiving space and conducting to the first portion of the contact plane, such that the first portion of the contact plane is defined as a heating region. The cooling plane is facing toward the other part of the receiving space and conducting to the second portion of the contact plane, such that the second portion of the contact plane is defined as a cooling region. When the body is moved from a first position to a second position, the coating material is heated by the heating region, cooled by the cooling region and coated on the surface of a target object. Accordingly, alternative hot and cold treatments can be provided for the surface of the target object.

Accordingly, the thermoelectric cooling plate is received in the receiving space to allow a temperature difference to be defined by the contact plane. Therefore, the coating material is heated by the heating region, cooled by the cooling region and coated on the surface of a target object. As a result, the coating material can be efficiently absorbed by the surface of the target object due to the surface of the target object and the coating material are both heated, and cooled by the coating device. Moreover, the storage groove is defined at the body for storing the coating material, and the coating material can be fed into the storage groove by the material entrance and/or the feeding pipe. Therefore, the user does not need to have contact with the coating material and not need to take the coating device from the surface of the target object. Accordingly, hot and cold flows are circulated within the coating device to facilitate the permeation and the absorption of the coating material to the target object. Furthermore, the thermoelectric cooling plate, the vibrator, the handle or other components assembled with the body are detachable, such that the cleaning and the replacement of the components within the coating device can be performed easily and conveniently.

Detailed description of the characteristics and the advantages of the disclosure is shown in the following embodiments, the technical content and the implementation of the disclosure should be readily apparent to any person skilled in the art from the detailed description, and the purposes and the advantages of the disclosure should be readily understood by any person skilled in the art with reference to content, claims and drawings in the disclosure.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
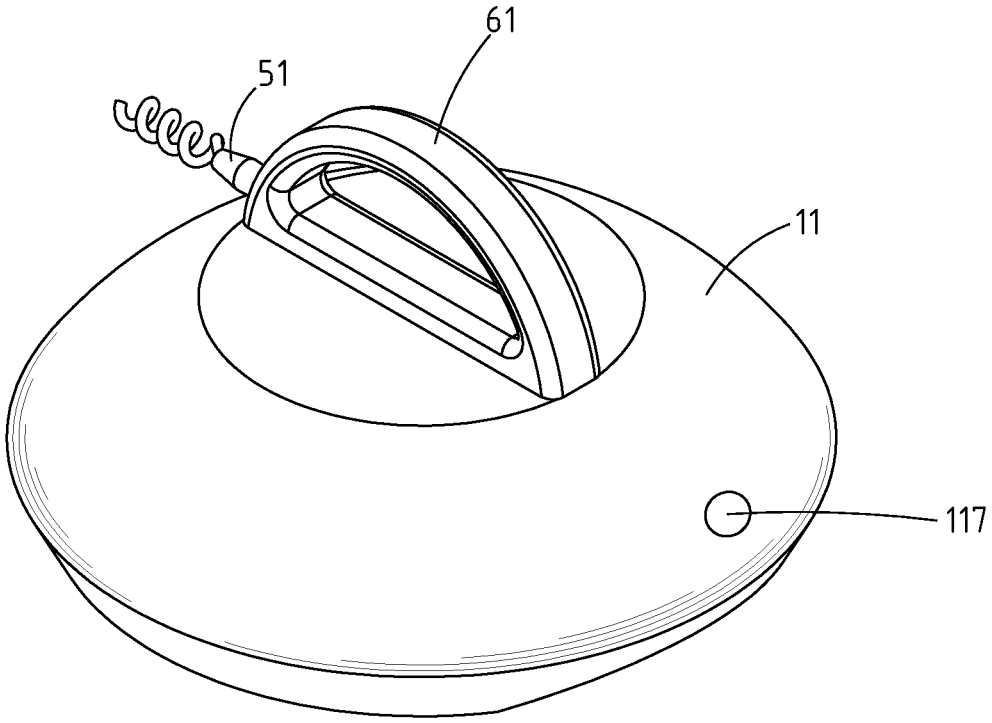
FIG. 1 is a perspective view of an exemplary embodiment of a coating device according to the instant disclosure.
Figure 2:
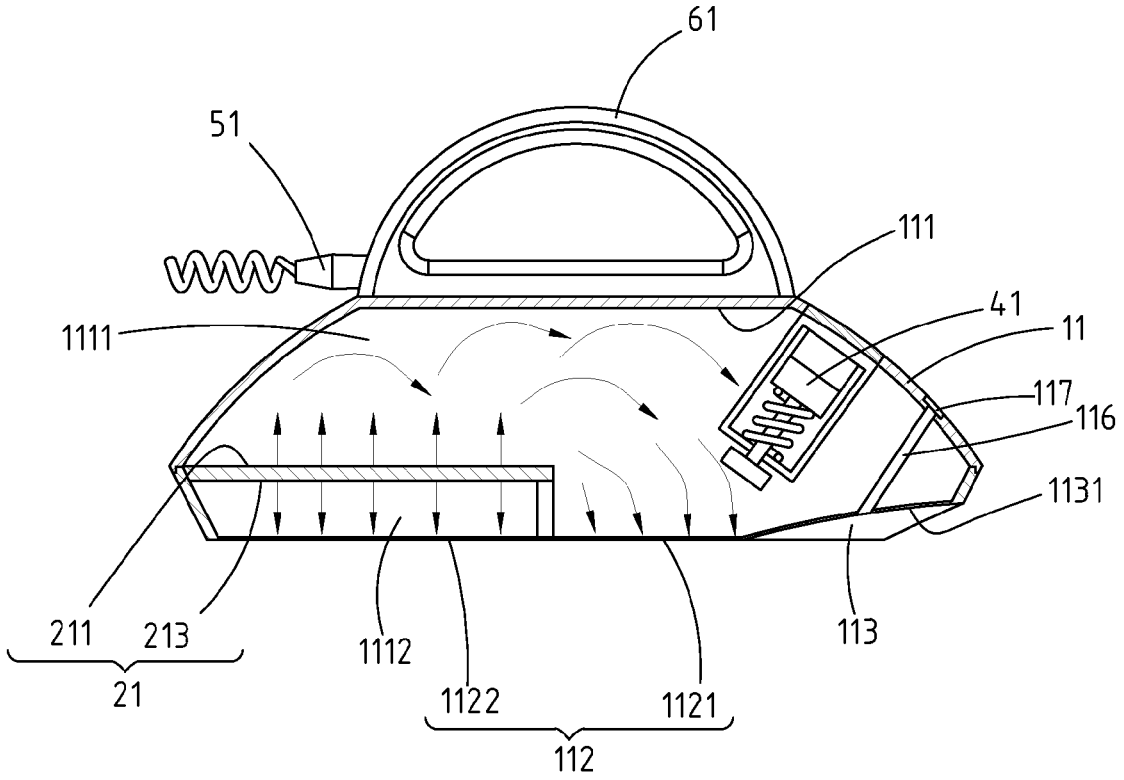
FIG. 2 is a lateral sectional view of the exemplary embodiment of the coating device according to the instant disclosure.
Figure 3:
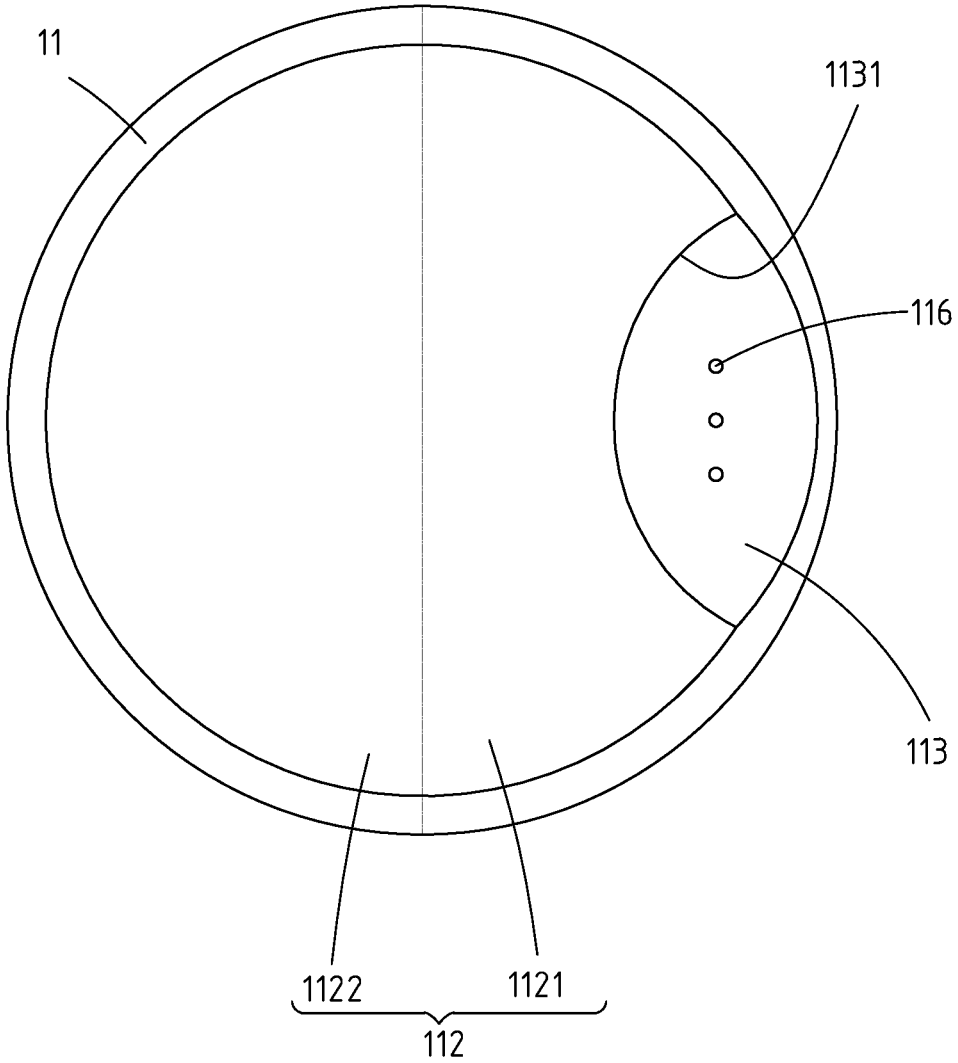
FIG. 3 is a bottom view of the exemplary embodiment of the coating device according to the instant disclosure.
Figure 5:
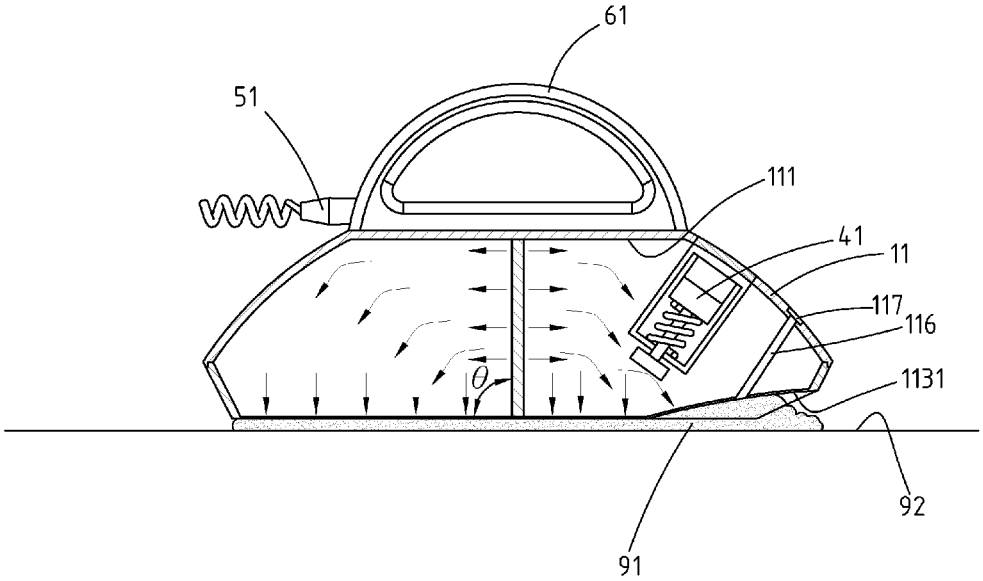
FIG. 5 is a lateral sectional view showing the operation of the coating device according to instant disclosure.

Please refer to FIG. 1 to FIG. 3, illustrating an exemplary embodiment of a coating device 1 according to the instant disclosure. FIG. 1 is a perspective view, FIG. 2 is a lateral sectional view, and FIG. 3 is a bottom view of the exemplary embodiment of the coating device 1 according to the instant disclosure. Here, the coating device 1 is adapted to generate a temperature difference for applying a coating material 91 on the surface of a target object. The target object may be user's skin, woods, textile. Taking the user's skin as an example, the coating material 91 may be beauty products or medical materials. The beauty products may be, but not limited to, fluid-type or semi-fluid-type beauty products. The fluid-type beauty products may be, but not limited to, oils. The semi-fluid-type beauty products may be, but not limited to, creams or lotions. The medical materials are functional ingredients provided to diminish inflammatory, to relief pain, to adjust hair follicle, to perform metabolism, etc., and are ingredients permeable to the enderonic layer of the skin. Here, the coating device 1 comprises a body 11 and a thermoelectric cooling plate 21. As shown in FIG. 5, alternative hot and cold treatments can be provided for the surface 92 of the target object by the coating device 1 to facilitate the permeation and the absorption of the coating material 91 to the target object.

Figure 9:
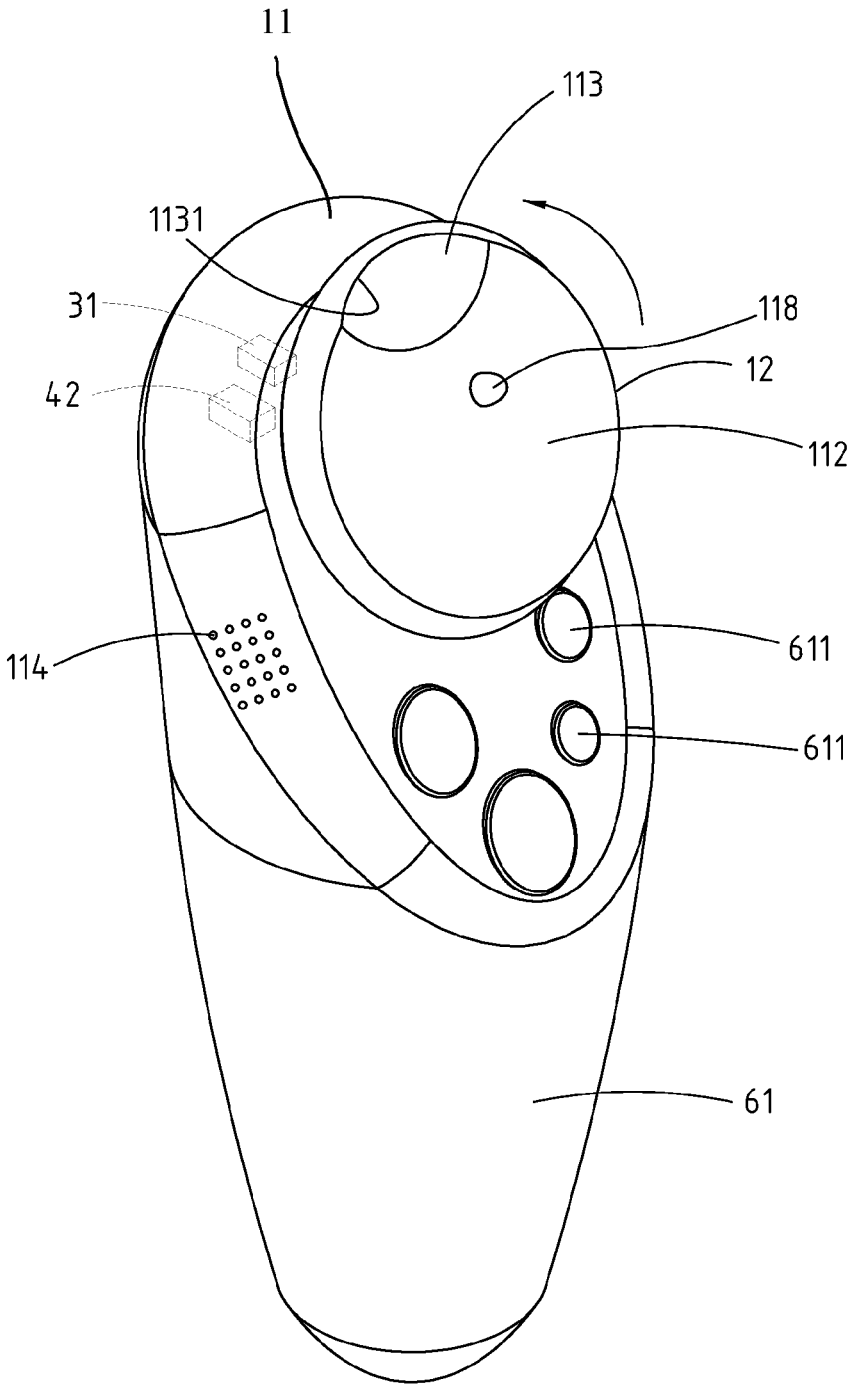
FIG. 9 is a perspective view of yet another variation of the exemplary embodiment of the coating device according to the instant disclosure.

As shown in FIG. 1 to FIG. 3, the body 11 may be disk-shaped. Alternatively, as shown in FIG. 9, the body 11 is bar-shaped. The body 11 may be a unitary shell integrally formed as a whole or may be combinable upper and lower casings. The body 11 is hollowed and defines a receiving space 111 therein. The receiving space 111 comprises a first partition 1111 and a second partition 1112.

Figure 4:
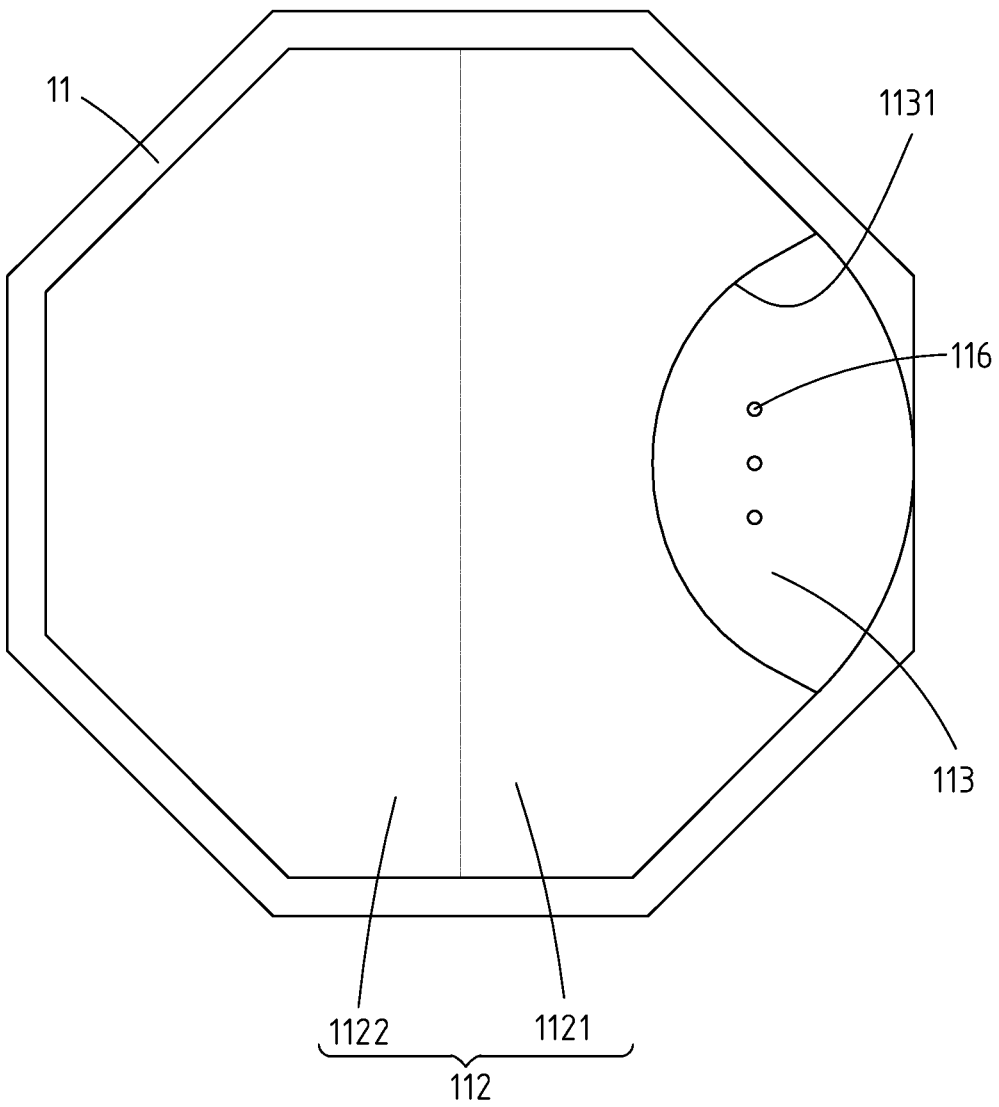
FIG. 4 is a bottom view of a variation of the exemplary embodiment of the coating device according to the instant disclosure.

Please refer to FIG. 1 and FIG. 2. A contact plane 112 is at one of two sides of the body 11, wherein the contact plane 112 has a first portion and a second portion. A storage groove 113 is defined at the body 11 and nearby the first portion of the contact plane 112 to store the coating material 91. Here, the contact plane 112 is planar and can be round-shaped or polygonal-shaped, as shown in FIG. 3 and FIG. 4. The storage groove 113 is a recessed cavity defined nearby the first portion of the contact plane 112. Here, the storage groove 113 has a material entrance 1131 defined at the edge of the contact plane 112. The material entrance 1131 is the front part of the connecting edge between the storage groove 113 and the contact plane 112. The front connecting edge is the connecting edge where the coating material 91 is feeding.

Please refer to FIG. 3, the rear part of the connecting edge may be a U-shaped edge and connects with the front part of the connecting edge. The size of the storage groove 113 is reduced gradually from the opening to the interior. Based on this, the coating material 91 may be fed into the storage groove 113 from the material entrance 1131 and may further flow out from the rear part of the connecting edge to coat on a surface 92 of a target object when the coating device 1 is moving.

Please refer to FIG. 2, in which the thermoelectric cooling plate 21 is a thin sheet. The thermoelectric cooling plate 21 is a semiconductor element. When applied with a low-voltage direct current, the thermoelectric cooling plate 21 can provide a cooling plane 213 and a heating plane 211 to cool down and/or heat up target objects. Furthermore, the thermoelectric cooling plate 21 is water washable, dryable, sterilizable and chemical-resisted.

Here, the thermoelectric cooling plate 21 is received in the receiving space 111. That is, the thermoelectric cooling plate 21 is between the first partition 1111 and the second partition 1112. In this embodiment, the first partition 1111 corresponds to a heating region 1121 of the contact plane 112, and the second partition 1112 corresponds to a cooling region 1122 of the contact plane 112. Moreover, the thermoelectric cooling plate 21 has a heating plane 211 and a cooling plane 213 respectively defined at opposite sides thereof. The heating plane 211 and the cooling plane 213 may be made of metal (such as aluminum), ceramic, etc. The heating plane 211 and the cooling plane 213 are washable, dryable, sterilizable and disinfectable.

Please refer to FIG. 2. The heating plane 211 faces the first partition 1111 of the receiving space 111 and the cooling plane 213 faces the second partition 1112 of the receiving space 111. The heat generated from the heating plane 211 is delivered to the heating region 1121 by the first partition 1111. The cooling region 1122 is cooled down by the heat convection within the second partition 1112. That is, the heating plane 211 is facing toward one of two parts of the receiving space 111, conducting to the first portion of the contact plane 112, and delivering heat to the first portion of the contact plane 112, such that the first portion of the contact plane 112 is defined as the heating region 1121. The cooling plane 213 is facing toward the other part of the receiving space 111, conducting to the second portion of the contact plane 112, and delivering cold flows to the second portion of the contact plane 112, such that the second portion of the contact plane 112 is defined as the cooling region 1122. In this embodiment, the temperature difference between the heating temperature of the heating region 1121 and the cooling temperature of the cooling region 1122 may be 60 degree Celsius. Alternatively, the temperature difference between the heating temperature of the heating region 1121 and the cooling temperature of the cooling region 1122 may be 80 degree Celsius or higher.

For example, when the coating device 1 is applied to human skin, the temperature difference between the heating temperature of the heating region 1121 and the cooling temperature of the cooling region 1122 is within a human-skin sustainable range. Generally, when the heating temperature is higher than 60 degree Celsius, human skin can hardly suffer such high temperature and would possibly be burned; while when the cooling temperature is lower than 0 degree Celsius, human skin would be nipped.

When the coating device 1 is applied to target objects like woods, textiles, etc., the temperature difference between the heating region 1121 and the cooling region 1122 may be greater than that of coating device 1 to be applied to human skin.

It is understood that the range of the temperature difference between the heating region 1121 and the cooling region 1122 provided above is illustrative and does not limit to the instant disclosure. In some implementation aspects, to adapt to different target objects, the heating temperature of the heating region 1121 and the cooling temperature of the cooling region 1122 are adjustable. In detail, if the coating device 1 is applied to human skin, the heating temperature would not be greater than the temperature capable of burning skin, and the cooling temperature would not be lower than the temperature capable of nipping skin. While, if the coating device 1 is applied to woods, the temperature difference between the heating region 1121 and the cooling region 1122 would be less than the temperature difference between the heating region 1121 and the cooling region 1122 when applied to human skin.

Please refer to FIG. 2 and FIG. 5. In this embodiment, the thermoelectric cooling plate 21 is received in the receiving space 111 freely. Here, as shown in FIG. 5, the thermoelectric cooling plate 21 is received in a middle portion of the receiving space 111 and an angle θ is defined between the thermoelectric cooling plate 21 and the contact plane 112. The angle θ may be, for example, 0 degree, 15 degrees, 35 degrees, 55 degrees or 90 degrees. When the angle θ is 0 degree, the thermoelectric cooling plate 21 is parallel to the contact plane 112, as shown in FIG. 2. While when the angle θ is 90 degrees, the thermoelectric cooling plate 21 is perpendicular to the contact plane 112.

When the angle θ is 15 degrees, the volume of the first partition 1111 would be greater than the volume of the second partition 1112. Therefore, the temperature of the heating region 1121 would raise more slowly due to the greater volume of the first partition 1111 and due to the heating plane 211 is rather far away from the heating region 1121 of the contact plane 112, and the temperature of the cooling region 1122 would drop more quickly due to the smaller volume of the second partition 1112 and due to the cooling plane 213 is rather closer to the cooling region 1122 of the contact plane 112.

As shown in FIG. 5, when the angle θ is 90 degrees, the volume of the first partition 1111 is approximately equal to the volume of the second partition 1112. That is, the heating rate of the first partition 1111 is approximately equal to the cooling rate of the second partition 1112, and the heating rate of the heating region 1121 of the contact plane 112 is approximately close to the cooling rate of the cooling region 1122 of the contact plane 112.

Please refer to FIG. 5, when operating, the body 11 of the coating device 1 is moved from a first position to a second position of the surface 92 of a target object. Following descriptions are provided to explain the operation of the coating device 1. Firstly, the portion of the surface 92 at where the coating material 91 is located and the coating material 91 stored in the storage groove 113 are heated by the heating region 1121. Therefore, the mobility or the activity of the coating material 91 can be improved. Furthermore, when the coating device 1 is applying to human skin, skin pores nearby the coating material 91 or nearby the heating region 1121 can be expanded, and the blood circulation of the skin nearby the coating material 91 or nearby the heating region 1121 can be increased. And then, the coating device 1 is further moved, so that the coating material 91 is further moved to the cooling region 1122. Therefore, the surface 92 of the target object is cooled by the cooling region 1122, and the coating material 91 becomes prone to be attached or adhered to the surface 92 of the target object. Furthermore, when the coating device 1 is applying to human skin, the cooling effect provided from the cooling region 1122 further allows skin pores nearby the coating material 91 or nearby the cooling region 1122 can be refined, and the coating material 91 can be sufficiently absorbed by the surface 92 of the target object.

Please refer to FIG. 2. The body 11 further comprises a vibrator 41 received in the receiving space 111. When the coating device is operated, the vibrator 41 allows the body 11 of the coating device 1 to vibrate, such that the coating material 91 and the surface 92 of the target object are rubbed against the body 11. Therefore, the coating device 1 provides a massaging effect to the surface 92 and facilitates the absorbing performance of the coating material 91 for the surface. Here, the vibrator 41 is received in the first partition 1111 of the receiving space 111, and the vibrator 41 allows the heating region 1121 of the contact plane 112 to be vibrated, but embodiments are not limited thereto. Alternatively, the vibrator 41 is received in the second partition 1112, or received between the first partition 1111 and the second partition 1112.

Please refer to FIG. 2. The body 11 further comprises a power supply 51 connected to the thermoelectric cooling plate 21. Here, the power supply 51 is, but not limited to, built in the body 11 or externally connected to the body 11 and provides electricity to the coating device 1.

Figure 6:
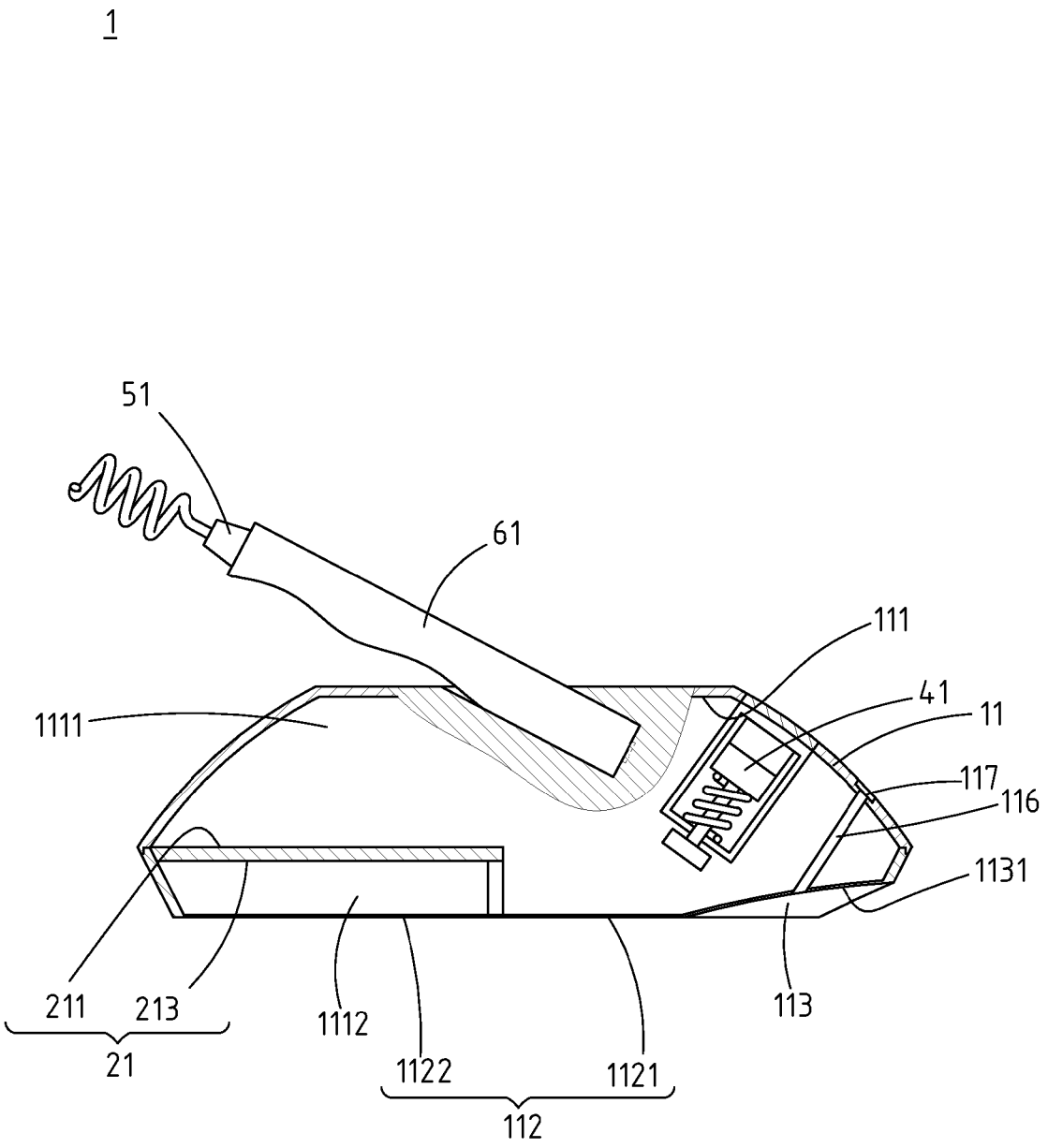
FIG. 6 is a lateral sectional view of another variation of the exemplary embodiment of the coating device according to the instant disclosure.
Figure 7:
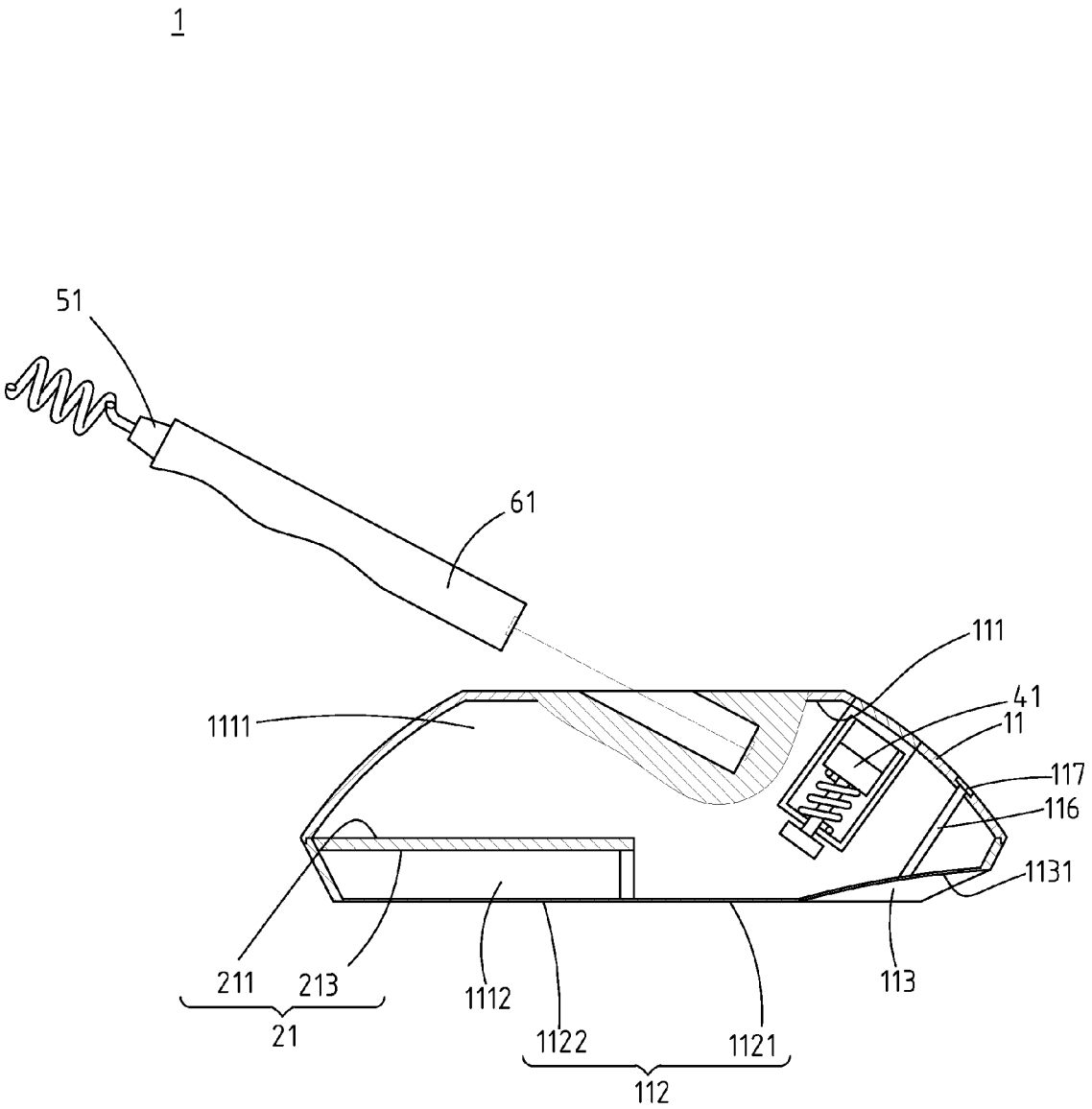
FIG. 7 is a partial exploded view of another variation of the exemplary embodiment of the coating device according to the instant disclosure.
Figure 8:
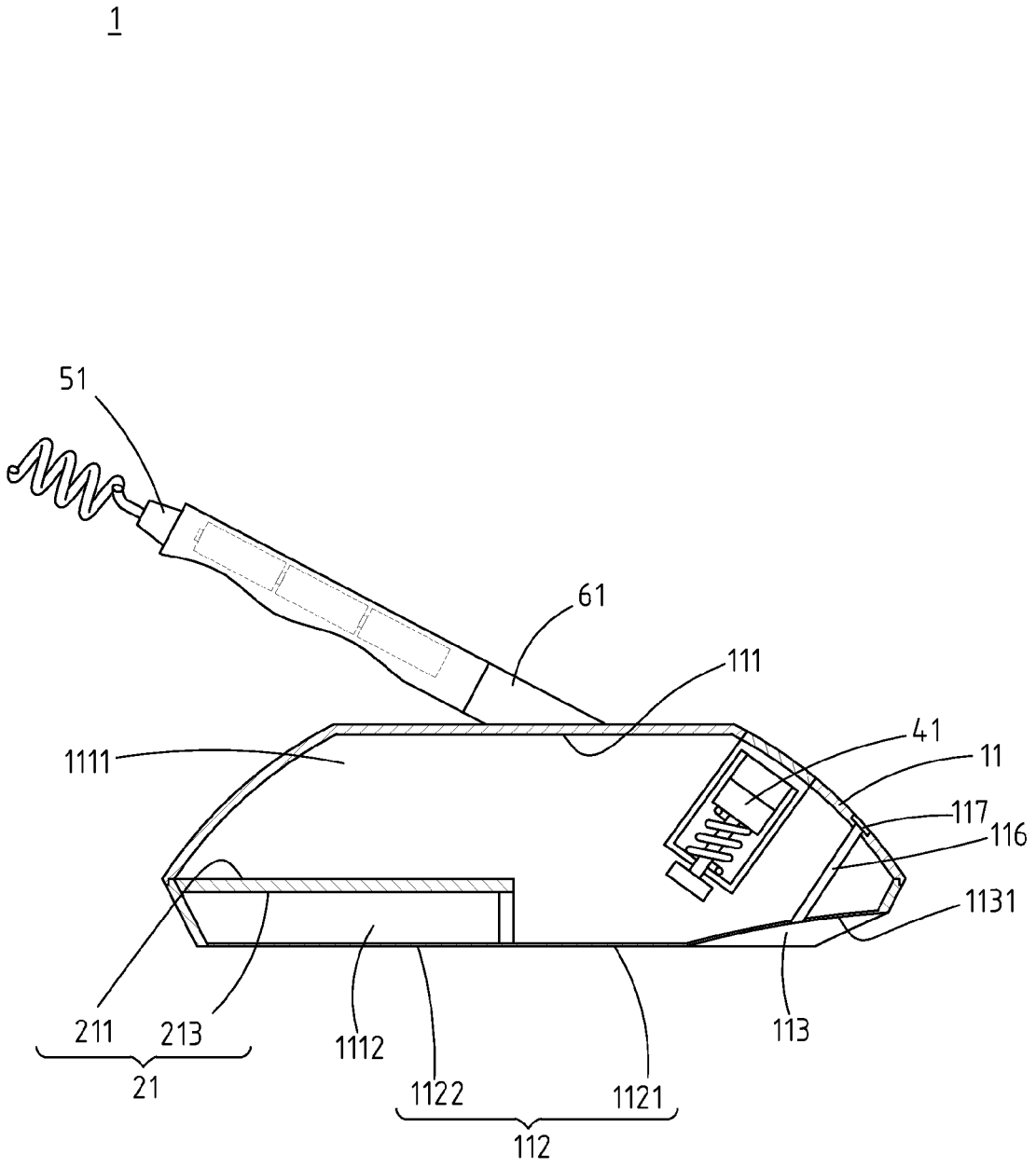
FIG. 8 is a variation of the instant disclosure shown in FIG. 6.

Please refer to FIG. 2. The body 11 further comprises a handle 61 at the other side thereof. The outline of the handle 61 may be, D-profiled or bar-shaped (as shown in FIG. 6 and FIG. 7). The handle 61 is provided for holding or hanging. Furthermore, a market-available connecting cable may be provided to connect to the handle 61 for power supply; alternatively, rechargeable or disposable batteries may be received in the handle 61 for power supply, as shown in FIG. 8.

Please refer to FIG. 9. The coating device 1 further comprises a rotating plate 12 connected to the body 11. As shown, the body 11 is assembled to an upper portion of the handle 61, and the rotating plate 12 is connected to the handle 61 via the body 11. The surface of the rotating plate 12 is the contact plane 112 corresponding to the storage groove 113 of the body 11. The position of the storage groove 113 relative to the body 11 can be altered by rotating the rotating plate 12, so that the material entrance 1131 of the storage groove 113 is arranged to face the upper, the lower, the left or the right directions of the coating device 1 as shown in FIG. 9. Furthermore, the position of the heating region 1121 and the position of the cooling region 1122 may be exchanged with each other by rotating the rotating plate 12. Based on this, when the coating device 1 is operated, the body 11 of the coating device 1 is moved from a first position to a second position on the surface 92 of a target object (for example, on the skin of a user) along a top-to-bottom direction, a left-to-right direction or an arbitrary direction.

In some implementation aspects, the handle 61 comprises a plurality of operating interfaces 611. The operating interfaces 611 may be physical buttons or touch screens. The operating interfaces 611 are provided for users to adjust the temperature of the contact plane 112. Therefore, the coating device 1 is applicable to gels, lotions, creams, oils, aqueous solutions, etc. with different melting points, mobilities and/or viscosities. Furthermore, the operating interfaces 611 may be also provided for users to adjust the vibrating frequency of the vibrator 41. Thus, the massaging provided from the coating device 1 can be further improved to allow the user feel comfortable.

Please refer to FIG. 9. The coating device 1 further comprises a plurality of heat dissipating vents 114 defined on the body 11 or on the handle 61. Accordingly, heats would not be accumulated within the body 11 when the coating device 1 is used for a period of time. Therefore, when the coating device 1 is operated to coat cosmetics to human skin, the safety can be ensured. Furthermore, the body 11 further comprises a sensing member 31 connected to the thermoelectric cooling plate 21. Therefore, the temperature of the thermoelectric cooling plate 21 can be adjusted automatically by the sensing member 31 when the temperature of the thermoelectric cooling plate 21 is too high or too low. In addition, the body 11 further comprises a flow guiding structure 118 at the contact plane 112. Here, the flow guiding structure 118 may has a protruded point structure, a finger-profile structure or other structures corresponding to the surface 92 of the target object. Furthermore, the flow guiding structure 118 allows a user to use the coating device 1 for coating the coating material 91 on the surface 92 of the target object conveniently even if his/her hands are slightly disabled.

Moreover, the coating device 1 may further comprise an ultrasonic vibrator 42 adapted in the body 11. Therefore, coating materials 91 like cosmetics can be oscillated due to the vibration provided from the ultrasonic vibrator 42 and divided into small particles, hence facilitating the skin of the user absorbing the cosmetics easily. As a result, the skincare effect or the curing performance provided by the coating material 91 can be improved.

Please refer to FIG. 2 and FIG. 5. The body 11 further comprises a feeding pipe 116, one of two openings of the feeding pipe 116 communicates with the storage groove 113, and the other opening of the feeding pipe 116 communicates with outside of the body 11. That is, the body 11 has at least one through hole (namely, the feeding pipe 116) defined therethrough. The feeding pipe 116 is defined at a portion of the body 11 corresponding to the storage groove 113. The storage groove 113 communicates with the outside of the body 11 via the feeding pipe 116. Here, a seal 117 is further provided to cover the opening of the feeding pipe 116 at the other side of the body 11. When the seal 117 is removed, the coating material 91 can be fed into the storage groove 113 via the feeding pipe 116 of the body 11. Therefore, the user can apply the coating material 91 from the storage groove 113 on the surface 92 of the target object continuously, and the user does not need to take the coating device 1 from the surface 92 of the target object when feeding the coating material 91. Moreover, the user does not have contact with the coating material 91 when feeding the coating material 91.

According to the instant disclosure, the thermoelectric cooling plate is received in the receiving space to allow a temperature difference to be defined by the contact plane. Therefore, the coating material is heated by the heating region, cooled by the cooling region and coated on the surface of a target object. As a result, the coating material can be efficiently absorbed by the surface of the target object due to the surface of the target object and the coating material are both heated, and cooled by the coating device. Moreover, the storage groove is defined at the body for storing the coating material, and the coating material can be fed into the storage groove by the material entrance and/or the feeding pipe. Therefore, the user does not need to be in contact with the coating material and not need to take the coating device from the surface of the target object. Accordingly, alternative hot and cold treatments can be provided for the surface of the target object to facilitate the permeation and the absorption of the coating material to the target object. Furthermore, the thermoelectric cooling plate, the vibrator, the handle or other components assembled with the body are detachable, such that the cleaning and the replacement of the components within the coating device can be performed easily and conveniently.

Besides, the coating device can be provided to generate a temperature difference for the activation of human skin, for the formation of the collagen in the enderonic player of the skin, and for the increase of the density of the enderonic layer of the skin to firm the skin. Moreover, the flow guiding structure allows an user to use the coating device for coating the coating material on the surface of the target object conveniently even if the hands of the user are slightly disabled due the profile of the flow guiding structure facilitating the user to hold the coating device. Therefore, the user can apply coating material on the surface of the target object with the aids of the coating device. Furthermore, since the coating device is detachable, the coating device can be cleaned thoroughly before and after use. Besides, the coating device is sterilizable and disinfectable, such that the hygiene care of a user can be guaranteed when the coating device is applied to the skin of the user.

While the disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A coating device, comprising:

a body, comprising:

a receiving space defined therein;

a contact plane, at one of two sides of the body, wherein the contact plane has a first portion and a second portion; and a storage groove, defined at the body and nearby the first portion of the contact plane to store a coating material;

a thermoelectric cooling plate, received in the receiving space, the thermoelectric cooling plate comprising:

a heating plane, facing toward one of two parts of the receiving space and conducting to the first portion of the contact plane, such that the first portion of the contact plane is defined as a heating region; and a cooling plane, facing toward the other part of the receiving space and conducting to the second portion of the contact plane, such that the second portion of the contact plane is defined as a cooling region;

wherein, when the body is moved from a first position to a second position, the coating material is adapted to be heated by the heating region, cooled by the cooling region and coated on a surface.

2. The coating device according to claim 1, wherein a temperature difference is defined between a heating temperature of the heating region and a cooling temperature of the cooling region.

3. The coating device according to claim 1, wherein an angle is defined between the thermoelectric cooling plate and the contact plane.

4. The coating device according to claim 1, wherein the receiving space comprises a first partition and a second partition, and the thermoelectric cooling plate is between the first partition and the second partition.

5. The coating device according to claim 4, wherein the volume of the first partition is equal to or greater than the volume of the second partition.

6. The coating device according to claim 1, wherein the contact plane of the body is round-shaped or polygonal-shaped.

7. The coating device according to claim 1, wherein the body comprises a vibrator received in the receiving space.

8. The coating device according to claim 1, wherein the body comprises a power supply connected to the thermoelectric cooling plate.

9. The coating device according to claim 1, wherein the body comprises a handle at the other side thereof.

10. The coating device according to claim 9, wherein the handle comprises a plurality of operating interfaces.

11. The coating device according to claim 1, wherein the storage groove has a material entrance defined at an edge of the contact plane.

12. The coating device according to claim 1, further comprising a plurality of heat dissipating vents defined on the body.

13. The coating device according to claim 1, wherein the body further comprises a sensing member connected to the thermoelectric cooling plate.

14. The coating device according to claim 1, wherein the contact plane is a surface of a rotating plate connected to the body.

15. The coating device according to claim 1, further comprising an ultrasonic vibrator adapted in the body.

16. The coating device according to claim 1, wherein the body further comprises a feeding pipe, one of two openings of the feeding pipe communicates with the storage groove, and the other opening of the feeding pipe communicates with outside of the body.

17. The coating device according to claim 1, wherein the body further comprises a flow guiding structure at the contact plane.

* * * * *